US006004737A

United States Patent [19]

Merkel et al.

[11] Patent Number: 6,004,737

[45] Date of Patent: Dec. 21, 1999

[54] PHOTOGRAPHIC ELEMENT CONTAINING A YELLOW DIR COUPLER

[75] Inventors: Paul B. Merkel, Victor; David A. Steele, Webster; Jerrold N. Poslusny, Rochester, all of N.Y.

[73] Assignee: Eastman Kodak Company, Rochester, N.Y.

[21] Appl. No.: 08/896,843

[22] Filed: Jul. 18, 1997

[51] Int. Cl.[6] ..... G03C 1/08; G03C 7/26; G03C 7/32

[52] U.S. Cl. ..... 430/544; 430/505; 430/557; 430/957

[58] Field of Search ..... 430/505, 544, 430/557, 957, 567

[56] References Cited

U.S. PATENT DOCUMENTS

| | | | |
|---|---|---|---|
| 4,182,630 | 1/1980 | Quaglia | 430/558 |
| 4,315,069 | 2/1982 | Scott et al. | 430/557 |
| 4,368,225 | 1/1983 | Nussbaum | 420/31 |
| 4,579,816 | 4/1986 | Ohlschlager et al. | 430/557 |
| 4,833,070 | 5/1989 | Kunitz et al. | 430/505 |
| 4,840,880 | 6/1989 | Ohlschlager et al. | 430/544 |
| 4,897,341 | 1/1990 | Odenwalder et al. | 430/557 |
| 4,992,360 | 2/1991 | Tsuruta et al. | 430/557 |
| 5,021,331 | 6/1991 | Vetter et al. | 430/544 |
| 5,451,492 | 9/1995 | Merkel et al. | 430/505 |
| 5,616,680 | 4/1997 | Linstid, III | 528/183 |
| 5,736,307 | 4/1998 | Bertoldi et al. | 430/544 |

FOREIGN PATENT DOCUMENTS

| | | |
|---|---|---|
| 747 415 A2 | 12/1996 | European Pat. Off. . |
| 747763 | 12/1996 | European Pat. Off. . |
| 4-313750 | 11/1992 | Japan . |
| 7152119 | 6/1995 | Japan . |
| 7159948 | 6/1995 | Japan . |

*Primary Examiner*—Geraldine Letscher
*Attorney, Agent, or Firm*—Edith A. Rice

[57] ABSTRACT

A photographic element comprises a support bearing at least one silver halide emulsion and at least one acylacetanilide yellow dye-forming DIR coupler of structure I, below

I wherein:

the $R_1$ is a tertiary alkyl group or a phenyl group;

X is a halogen atom, an alkoxy group or an alkyl group;

$R_2$ is one or more substituent in the para position or either meta position relative to the anilino nitrogen and individually selected from the group consisting of halogen atoms, and alkyl, phenyl, alkoxycarbonyl, aryloxycarbonyl, sulfonamido, sulfamoyl, sulfonate, alkylsulfonyl, arylsulfonyl, sulfoxyl, acyloxy, carbamoyl, acyl, carbonamido and cyano groups;

n is 1, 2 or 3;

$R_3$ is an alkyl group having at least 6 carbon atoms or a phenyl group.

11 Claims, No Drawings

PHOTOGRAPHIC ELEMENT CONTAINING A YELLOW DIR COUPLER

FIELD OF THE INVENTION

This invention relates to a photographic element containing a yellow DIR coupler

BACKGROUND OF THE INVENTION

Many photographic materials, particularly color negative films, contain so-called DIR (development inhibitor releasing) couplers. In addition to forming imaging dye, DIR couplers release inhibitors that can restrain silver development in the layer in which release occurs as well as in other layers of a multilayer photographic material. DIR couplers can help control gamma or contrast, can enhance sharpness or acutance, can reduce granularity and can provide color correction via interlayer interimage effects.

To provide suitable inhibition of silver development and the desirable photographic effects thereof, a DIR coupler must release an inhibitor that effectively interacts with silver and/or silver halide during development. In addition to being of the proper structural type, the inhibitor must have the proper degree of hydrophobicity to adsorb efficiently to silver and/or silver halide grains and to retard efficiently silver development. An inhibitor becomes more hydrophobic as the number of carbons in an alkyl chain increases. If the degree of hydrophobicity of the inhibitor is too low it will not effectively inhibit silver development, thus inhibitors with insufficient numbers of carbon atoms or other hydrophopic substituents tend to be inefficient. If the hydrophobicity of a prospective inhibitor becomes too high, its effectiveness also tends to be diminished, since it may become so insoluble in the aqueous developer solution that most of it remains in dispersion droplets rather than diffusing to silver or silver halide particles. Inhibitors that are too hydrophobic also tend to deliver insufficient interlayer interimage, since little inhibitor can diffuse out of the layer in which it is generated.

Triazole releasing DIR couplers are disclosed in U.S. Pat. Nos. 4,182,630, 4,315,069, 4,368,225, 4,833,070 and 5,021,331, Japanese published patent applications Kokai Nos. 07/152,119 A and 07/159,948 A, Czechoslovakian patents 249,556 B1, 249,557 B1 and 261,415 B1 and European patent application 747,415. None of these references teach or suggest the structural features required to achieve all of the desirable properties of the DIR couplers of this invention.

PROBLEM TO BE SOLVED BY THE INVENTION

There has been a need for more effective yellow dye-forming DIR couplers. Yellow DIR couplers that provide high interimage color correction are particularly desirable for modern color negative films. In addition, it is desirable that such couplers have high activity to maximize rates and efficiencies of inhibitor release and minimize laydowns. DIR couplers that show acceptably low continued coupling when films containing them are placed in a bleach solution immediately after development (i.e. with no intervening stop bath) are also needed. It is also desirable that the inhibitors released from DIR couplers are readily hydrolyzed to weak inhibitors in the developer solution to prevent seasoning of the developer on extended use. The DIR couplers of this invention possess all of these desirable properties, particularly high activity, the propensity to provide good interlayer interimage and the release of effective hydrolyzable inhibitors. The DIR couplers of this invention are designed to release inhibitors of the proper hydrophobicity for efficient inhibition and high interlayer interimage.

SUMMARY OF THE INVENTION

One aspect of this invention comprises a photographic element comprising a support bearing at least one silver halide emulsion and at least one acylacetanilide yellow dye-forming DIR coupler of structure I, below

I

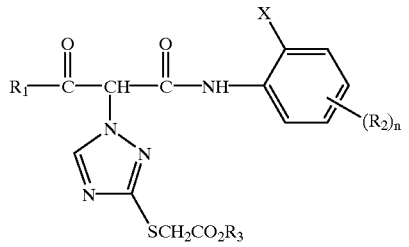

wherein:

the $R_1$ is a tertiary alkyl group or a phenyl group;

X is a halogen atom, an alkoxy group or an alkyl group;

$R_2$ is one or more substituent in the para position or either meta position relative to the anilino nitrogen and individually selected from the group consisting of halogen atoms, and alkyl, phenyl, alkoxycarbonyl, aryloxycarbonyl, sulfonamido, sulfamoyl, sulfonate, alkylsulfonyl, arylsulfonyl, sulfoxyl, acyloxy, carbamoyl, acyl, carbonamido and cyano groups;

n is 1, 2 or 3;

$R_3$ is an alkyl group having at least 6 carbon atoms or a phenyl group.

ADVANTAGEOUS EFFECT OF THE INVENTION

The yellow DIR couplers or this invention provide high interimage color correction which is particularly desirable for modern color negative films. In addition, the DIR couplers have high activity to maximize rates and efficiencies of inhibitor release and minimize laydowns. The DIR couplers show acceptably low continued coupling when films containing them are placed in a bleach solution immediately after development (i.e. with no intervening stop bath). The inhibitors released from the DIR couplers are readily hydrolyzed to weak inhibitors in the developer solution to prevent seasoning of the developer on extended use. The DIR couplers of this invention possess all of these desirable properties, particularly high activity, the propensity to provide good interlayer interimage and the release of effective hydrolyzable inhibitors. The DIR couplers of this invention are designed to release inhibitors of the proper hydrophobicity for efficient inhibition and high interlayer interimage. The DIR couplers of this invention are also easily synthesized.

DETAILED DESCRIPTION OF THE INVENTION

This invention relates to a photographic element comprising a support bearing, at least one silver halide emulsion and at least one acylacetanilide yellow dye-forming DIR coupler of structure I, below

I

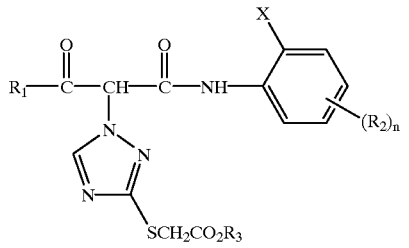

wherein:

the $R_1$ is a tertiary alkyl group or a phenyl group;

X is a halogen atom, an alkoxy group or an alkyl group;

$R_2$ is one or more substituent in the para position or either meta position relative to the anilino nitrogen and individually selected from the group consisting of halogen atoms, and alkyl, phenyl, alkoxycarbonyl, aryloxycarbonyl, sulfonamido, sulfamoyl, sulfonate, alkylsulfonyl, arylsulfonyl, sulfoxyl, acyloxy, carbamoyl, acyl, carbonamido and cyano groups;

n is 1, 2 or 3;

$R_3$ is an alkyl group having at least 6 carbon atoms or a phenyl group.

$R_1$ may be a simple t-alkyl group such as t-octyl or a cyclic t-alkyl group in which two of the carbon atoms attached to the tertiary carbon join to form a ring, such as a 1-methylcyclopropyl group. In one particularly useful embodiment $R_1$ is a t-butyl group. In another useful embodiment X is a halogen atom, such as a chlorine or fluorine atom. In a particularly useful embodiment, n is 1 and $R_2$ is a sulfonamido group or an alkoxycarbonyl group para to the X group. In a preferred embodiment $R_3$ is an alkyl group with 7–12 carbon atoms. The proper selection of $R_3$ provides an inhibitor with the necessary hydrophobicity and strength to produce sufficient inhibition of silver development in the layer or color record in which the inhibitor is released yet sufficient mobility to produce efficient inhibition in adjacent layers or other color records, thereby providing the desired interlayer interimage.

The $R_3$ group allows the adjustment of inhibitor hydrophobicity and strength. The —$SCH_2CO_2R_3$ group is susceptible to ester hydrolysis to form a weak inhibitor, which prevents adverse photographic effects such as speed and gamma reduction, due to accumulation of strong inhibitors in the developer solution. The half life for hydrolysis of the —$SCH_2CO_2R_3$ group is approximately 40 min in a Kodak C-41 color negative developer at 38° C. This is sufficiently slow that little inhibitor is destroyed during the normal development time of several minutes, but sufficiently rapid to prevent accumulation of strong inhibitor that leaches out of films or other photographic materials upon extended use of the developer solution.

Preferably the photographic elements of this invention comprise the DIR couplers of this invention in the same layer with one or more blue-sensitive silver halide emulsions. In another particularly useful embodiment, at least one of the DIR couplers of this invention is coated in the same layer with at least one blue sensitive T-grain (i.e. tabular grain) emulsion as further described below.

The t-alkyl and pheny groups comprising $R_1$ may be unsubstituted or substituted. The alkyl groups comprising $R_2$, $R_3$ and X may be straight chain, branched or cyclic and may be unsubstituted or substituted. The alkoxy groups comprising X may be unbranched or branched and may be unsubstituted or substituted. The phenyl groups comprising $R_2$ an $R_3$ may also be unsubstituted or substituted. The alkoxycarbonyl, aryloxycarbonyl, sulfonamido, sulfamoyl, sulfonate, alkylsulfonyl, arylsulfonyl, sulfoxyl, acyloxy, carbamoyl, acyl and carbonamido groups comprising $R_2$ may also be further substituted. Any substituent may be chosen to further substitute the $R_1$–$R_3$ and X groups of this invention that does not adversely affect the performance of the acylacetanilide DIR couplers of this invention. Suitable substituents include halogen atoms, such as chlorine, alkenyl groups, alkynyl groups, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy-, aryloxy- and alkylamino-carbonamido groups), carbamoyl groups, carbamoyloxy groups, sulfonamido groups, sulfamoyl groups, alkylthio groups, arylthio groups, sulfoxyl groups, sulfonyl groups, sulfonyloxy groups, alkoxysulfonyl groups, aryloxysulfonyl groups, trifluoromethyl groups, cyano groups, imido groups and heterocyclic groups, such as 2-furyl, 3-furyl, 2-thienyl, 1-pyrrolyl, 2-pyrrolyl, 1-imidazolyl and N-succinimidyl groups. The phenyl groups comprising $R_1$ through $R_3$ may also be substituted with one or more unbranched, branched or cyclic alkyl groups.

Useful coated levels of the acylacetanilide DIR couplers of this invention range from about 0.005 to about 0.60 g/sq m, or more typically from 0.02 to 0.30 g/sq m.

The DIR couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. oleyl alcohol), phenols (e.g. p-dodecylphenol), carbonamides (e.g. N,N-dibutyldodecanamide or N-butylacetanalide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios range from about 1:0.1 to 1:8.0, with 1:0.2 to 1:4.0 being preferred. Examples of 3-alkylthio-1,2,4-triazole-releasing acylacetanilide DIR couplers of this invention include, but are not limited to A1–A14, below:

A1

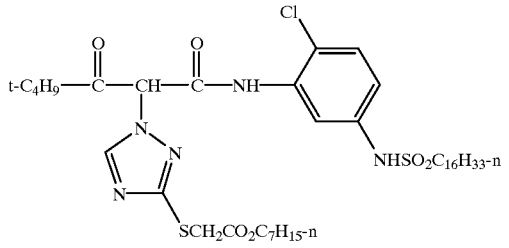

-continued
A2
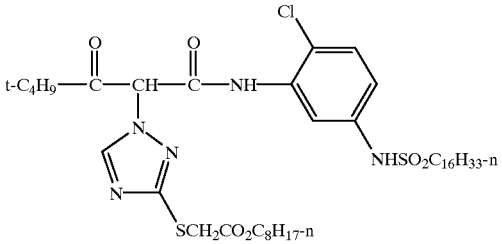
A3
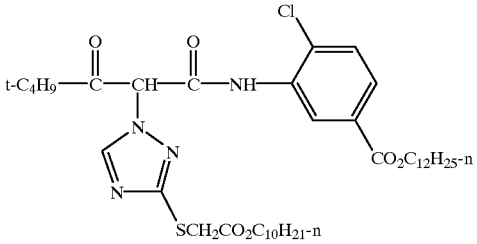
A4
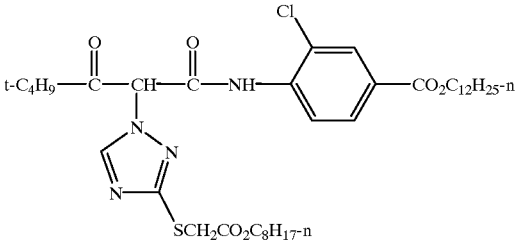
A5
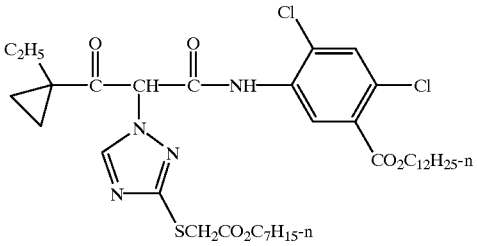
A6
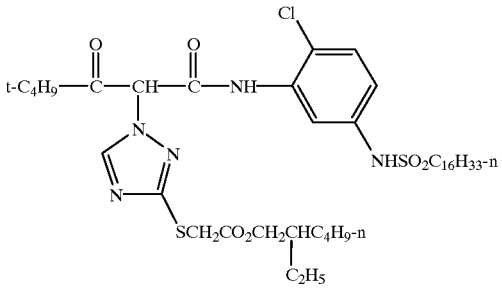
A7
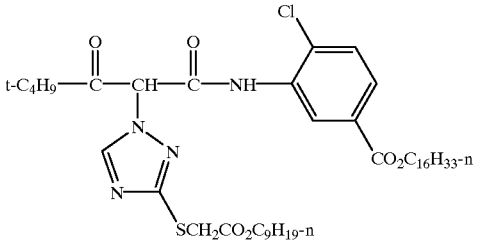
-continued
A8
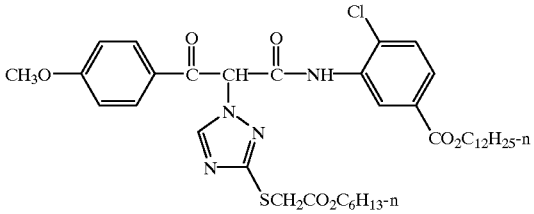
A9
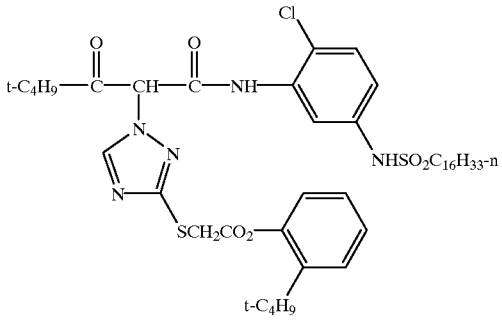
A10
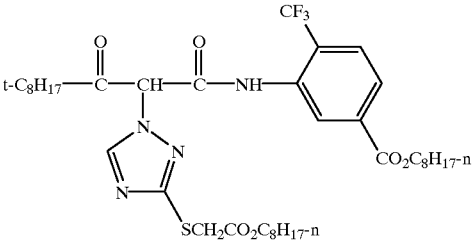
A11
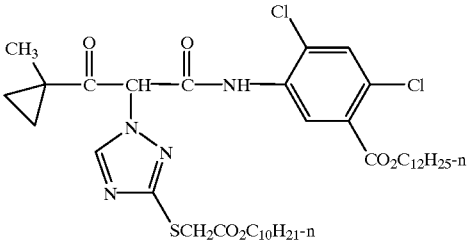
A12
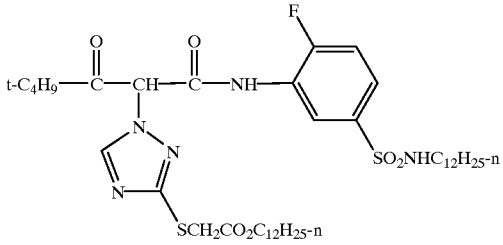
A13
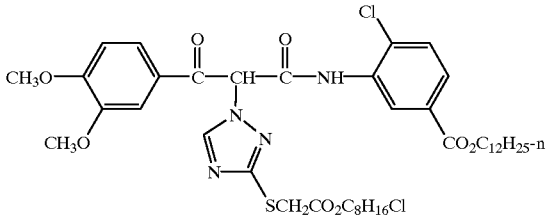

-continued

A14

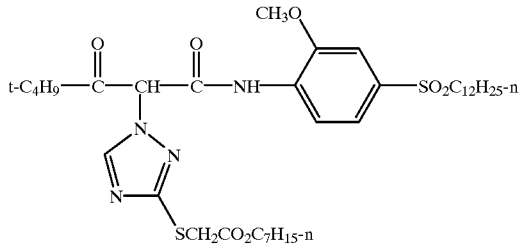

The DIR couplers of this invention may be used together with a variety of other types of couplers in the same layer or in different layers of a multilayer photographic material. Specifically contemplated is the use of the acylacetanilide yellow dye-forming DIR couplers of this invention in blue-sensitive photographic elements together with one or more acylacetanilide yellow dye-forming imaging couplers as defined by structure III, below.

III

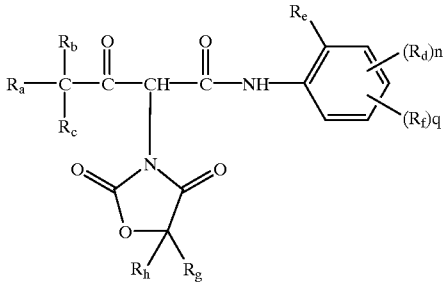

wherein:

$R_a$ is an alkyl, alkoxy, or aryloxy group;

$R_b$ is an alkyl or aryl group;

$R_c$ is hydrogen or an alkyl group;

$R_d$ is a substituent;

$R_e$ is selected from the group consisting of halogen, trifluoromethyl, alkoxy and aryloxy;

each $R_f$ is bonded at the 4- or 5-position relative to the anilino nitrogen and is independently a substituent selected from the group consisting of halogen, alkoxycarbonyl (—$CO_2G$), carbamoyl (—CONRG'), sulfonate (—$OSO_2G$), sulfamoyl (—$SO_2NGG'$), sulfonyl (—$SO_2G'$), trifluoromethyl, cyano, and sulfonamido (—$NRSO_2G'$), in which each G and G' is independently an alkyl group or an aryl group;

q is 1 or 2;

n is an integer from 0 to (3−q);

$R_g$ and $R_h$ are independently hydrogen or an alkyl group.

Particularly contemplated is the use of the DIR couplers of this invention in combination with couplers Y-1, Y-2 or Y-3, below:

Y-1

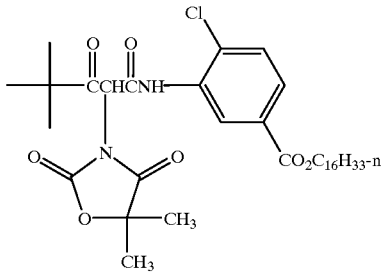

Y-2

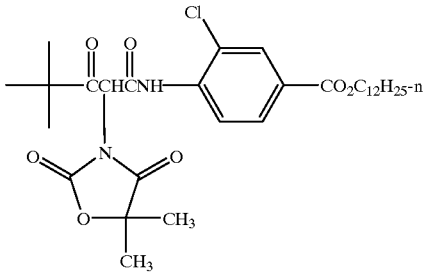

Y-3

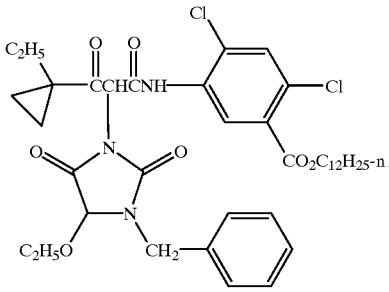

Use of the DIR couplers of this invention in color negative films comprising magnetic recording layers is also specifically contemplated. The efficient DIR couplers of this invention may allow reductions in the levels of yellow-colored magenta dye-forming masking couplers in such films, thereby lowering blue minimum densities, which may otherwise be undesirably high.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*,September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540, 653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexaco-ordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least I percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

EXAMPLE 1

Illustration of the Superior Inhibition and Provided by a DIR Coupler of this Invention To illustrate the superior inhibition and interlayer interimage provided by the DIR couplers of this invention, coupler A1 of this invention and comparative DIR coupler C1 were evaluated in the multilayer causer/receiver format shown in Table I. Comparative DIR coupler C1 is very similar to the primary yellow dye-forming coupler used in most Kodak color negative films. Structures of components that were not given previously are provided after Table II. Component laydowns in g/sq m are given in Table I in parentheses.

The DIR couplers were coated at a level of 135 micromoles/sq m. The DIR couplers were dispersed at a 1:1 weight ratio in dibutyl phthalate (S-2). The dispersions were prepared by adding an oil phase containing a 1:1:3 weight ratio of DIR coupler:S-2:ethyl acetate to an aqueous phase containing gelatin and the dispersing agent ALKANOL XC (Dupont) in a 10:1 weight ratio. The mixture was then passed through a colloid mill to disperse the oil phase in the aqueous phase as small particles. On coating, the ethyl acetate auxiliary solvent evaporates. Coupler Y-1 was dispersed with tritolyl phosphate (S-1, mixed isomers) at a 1:0.5 weight ratio.

Film samples were given a sensitometric white light (neutral) exposure and processed in a KODAK FLEXICOLOR C-41 process as in Table II. Blue (causer) and green (receiver) status M densities vs exposure were then measured for check film A without DIR coupler and for films with the comparative DIR coupler and the DIR coupler of this invention. Blue and green gamma values were then obtained from slopes of the plots of density vs log exposure. It is desirable that DIR couplers efficiently reduce gamma or contrast in the layer or color record in which they are coated to provide benefits such as enhanced sharpness, reduced granularity and improved exposure latitude. For high interlayer interimage and high color correction it is desirable that a DIR coupler produce substantial gamma reduction in receiver layers without too much gamma reduction in its own (causer) layer. In this case blue gamma corresponds to causer gamma and green gamma to receiver gamma. Blue and green gammas from neutral exposures are given in Table III. Ratios (R) of green gamma to blue gamma are also given in Table III. A lower value of R means that the DIR coupler produces a greater reduction in receiver gamma relative to causer gamma and thereby provides greater interlayer interimage and greater color correction.

TABLE I

| | |
|---|---|
| OVERCOAT: | Gelatin (5.38) |
| | Bis(vinylsulfonyl)methane Hardener (0.281) |
| CAUSER: | Y-1 (0.861) & S-1 (0.430) |
| and | A) No DIR Coupler (Uninhibited Check) |
| or | B) C1 (0.091) & S-2 (0.091) Comparison |
| or | C) A1 (0.105) & S-2 (0.105) Invention |
| | Green-Sens. 0.46 μm Silver Iodobromide Emulsion (0.807 Ag) Gelatin (2.69) |
| INTERLAYER: | IS-1 (0.054) & S-1 (0.054) |
| | Gelatin (0.86) |
| RECEIVER: | M-1 (0.430), S-1 (0.344) & ST-1 (0.086) |
| | Red-Sens. 0.46 μm Silver Iodobromide Emulsion (0.807 Ag) Tetraazaindine (0.019) |
| | Gelatin (2.69) |
| Cellulose Acetate Support with Gel U-Coat and Antihalation Backing | |

TABLE II

| Solution | Process Time | Agitation Gas |
|---|---|---|
| C-41 Developer | 3'15" | Nitrogen |
| Stop Bath | 30" | Nitrogen |
| Wash | 2'00" | None |

TABLE II-continued

| Solution | Process Time | Agitation Gas |
|---|---|---|
| Bleach | 3'00" | Air |
| Wash | 3'00" | None |
| Fix | 4'00" | Nitrogen |
| Wash | 3'00" | None |
| Wetting Agent Bath | 30" | None |
| Process temperature 100° F. (38°) | | |

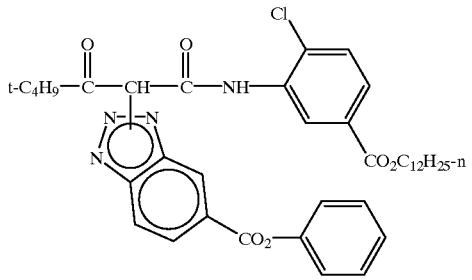

C1

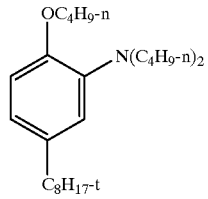

ST-1

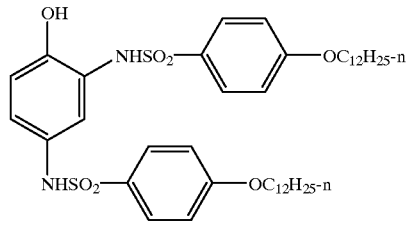

IS-1

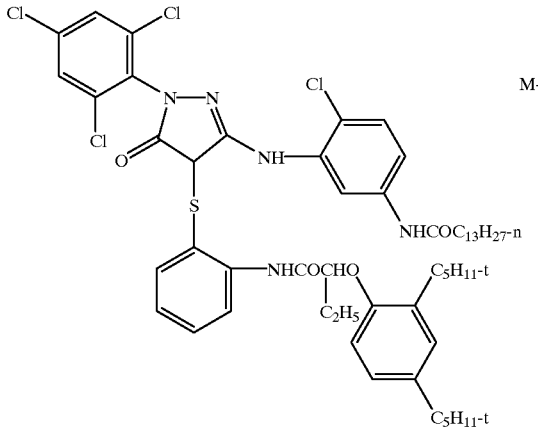

M-1

TABLE III

| Coating | DIR Coupler | Blue Gamma | Green Gamma | R* |
|---|---|---|---|---|
| A | None (check) | 1.76 | 1.50 | 0.85 |
| B | C1 (Comparison) | 1.16 | 0.93 | 0.80 |
| C | A1 (Invention) | 1.11 | 0.78 | 0.70 |

*R = ratio or green gamma to blue gamma

From the comparative data in Table III it is evident that both comparative DIR coupler C1 and DIR A1 of this invention effectively reduce blue gamma i.e. gamma in their own layer. DIR coupler A1 is slightly more efficient in reducing blue gamma. However, DIR coupler A1 of this invention is surprisingly more efficient in reducing green gamma in the receiving layer than comparative coupler C1. This results in a substantially lower R value with coupler A1 if this invention (0.70) than for coupler C1 (0.80), which is used in many commercial color negative films. In addition there is more than ½ stop green speed increase (0.20 log E) in coating C with A1 relative to coating B with C1, a highly desirable advantage.

EXAMPLE 2

Comparison of a DIR Coupler of This Invention With a Triazole-Releasing DIR Coupler of the Prior Art A second coating set was prepared to illustrate the superior inhibition efficiency and interlayer interimage of coupler A1 of this invention relative to a similar comparative coupler C2. The multilayer causer/receiver format of Example 1 was again used for this comparison. The coating structure is shown in Table V. Component laydowns in g/sq m are given in Table V in parentheses. The DIR couplers were dispersed as in example I and coated at a level of 135 micromoles/sq m. The structure of comparative coupler C2 is provided after Table V.

Film samples were given a sensitometric white light (neutral) exposure and processed in a KODAK FLEXICOLOR C-41 process as in Table II. Blue (causer) and green (receiver) status M densities vs exposure were then measured for check film A without DIR coupler and for films with the comparative DIR coupler and the DIR coupler of this invention. Blue and green gamma values were then obtained from slopes of the plots of density vs log exposure. It is desirable that DIR couplers efficiently reduce gamma or contrast in the layer or color record in which they are coated to provide benefits such as enhanced sharpness, reduced granularity and improved exposure latitude. For high interlayer interimage and high color correction it is desirable that a DIR coupler produce substantial gamma reduction in receiver layers without too much gamma reduction in its own (causer) layer. In this case blue gamma corresponds to causer gamma and green gamma to receiver gamma. Blue and green gammas from neutral exposures are given in Table VI. Ratios (R) of green gamma to blue gamma are also given in Table VI. A lower value of R means that the DIR coupler produces a greater reduction in receiver gamma relative to causer gamma and thereby provides greater interlayer interimage and greater color correction.

TABLE V

| | |
|---|---|
| OVERCOAT: | Gelatin (5.38)<br>Bis(vinylsulfonyl)methane Hardener (0.281) |
| CAUSER: | Y-1 (0.861) & S-1 (0.430)<br>and A) No DIR Coupler (Uninhibited Check)<br>or B) C2 (0.099) & S-2 (0.099) Comparison<br>or C) A1 (0.105) & S-2 (0.105) Invention<br>Green-Sens. 0.46 μm Silver Iodobromide Emulsion (0.807 Ag)<br>Gelatin (2.69) |
| INTERLAYER: | IS-1 (0.054) & S-1 (0.054)<br>Gelatin (0.86) |

TABLE V-continued

| | |
|---|---|
| RECEIVER: | M-1 (0.430), S-1 (0.344) & ST-1 (0.086)<br>Red-Sens. 0.46 μm Silver Iodobromide Emulsion (0.807 Ag)<br>Tetraazaindine (0.019)<br>Gelatin (2.69) |
| Cellulose Acetate Support with Gel U-Coat and Antihalation Backing | |

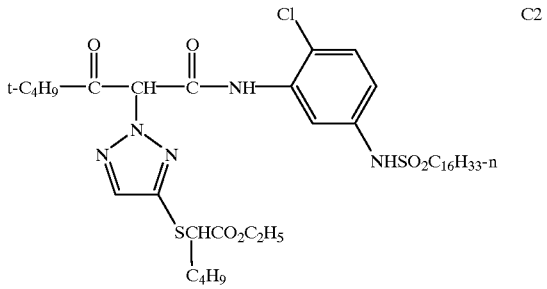

TABLE VI

| Coating | DIR Coupler | Blue Gamma | Green Gamma | R* |
|---|---|---|---|---|
| A | None (check) | 1.69 | 1.42 | 0.84 |
| B | C2 (Comparison) | 1.38 | 1.09 | 0.79 |
| C | A1 (Invention) | 1.11 | 0.78 | 0.70 |

*R is the ratio of green gamma to blue gamma

From the comparison data in Table VI it is evident that both comparative DIR coupler C2 and DIR A1 of this invention reduce blue (causer) gamma and green (receiver) gamma. However, DIR coupler A1 of this invention is much more efficient in reducing blue and green gamma values. Furthermore, DIR coupler A1 of this invention is considerably more effective in reducing the ratio R of green to blue gamma. The substantially lower R value (0.70) of coupler A1 of this invention relative to that of C2 (0.79) means that coupler A1 is much more effective in providing highly desirable blue onto green interimage. In addition there is a ½ stop (0.15 log E) green speed increase in coating C with A1 relative to coating B with C2, demonstrating another surprising advantage of coupler A1 of this invention.

EXAMPLE 3

Multilayer Film Structure Comprising a Yellow DIR Coupler of This Invention

The multilayer film structure utilized for this example is shown schematically in Table VII. Structures of components not provided previously are given immediately following Table VII. Component laydowns are provided in units of g/sq m unless otherwise indicated. This composition may also be coated on a support, such as polyethylene naphthalate, containing a magnetic recording layer. This film may be processed using KODAK FLEXICOLOR C-41 chemistry to yield excellent latitude, sharpness, color and interlayer interimage.

TABLE VII

| MULTILAYER FILM STRUCTURE | | |
|---|---|---|
| 1 | Overcoat & UV Layer: | Matte Beads<br>UV Absorbers UV-1 (0.108), UV-2 (0.108) & S-1 (0.151)<br>Silver Bromide Lippmann Emulsion (0.215 Ag)<br>Gelatin (1.237)<br>Bis(vinylsulfonyl)methane Hardener (1.75% of Total Gelatin) |
| 2 | Fast Yellow Layer: | Y-1 (0.236) Yellow Dye-Forming Coupler & S-1 (0.118)<br>A1 (0.080) DIR Coupler (Invention) & S-2 (0.080)<br>B-1 (0.0054) BARC & S-3 (0.0070)<br>Blue Sensitive Silver Iodobromide Emulsion (0.377 Ag),<br>4.1 mole % Iodide T-Grain (2.9 × 0.12 μm)<br>Blue Sensitive Silver Iodobromide Emulsion (0.108 Ag)<br>4.1 mole % Iodide T-Grain (1.9 × 0.14 μm)<br>Gelatin (0.807) |
| 3 | Slow Yellow Layer: | Y-1 (1.076) & S-1 (0.538)<br>A1 (0.080) (Invention) & S-2 (0.080)<br>B-1 (0.022) & S-3 (0.0028)<br>CC-1 (0.032) & S-2 (0.064) μm<br>IR-4 (0.032) & S-2 (0.064)<br>Blue Sensitive Silver Iodobromide Emulsion (0.398 Ag),<br>4.1 mole % Iodide T-Grain (1.9 × 0.14 μm)<br>Blue Sensitive Silver Iodobromide Emulsion (0.269 Ag),<br>1.3 mole % Iodide T-Grain (0.54 × 0.08 μm)<br>Blue Sensitive Silver Iodobromide Emulsion (0.247 Ag)<br>1.5 mole % Iodide T-Grain (0.77 × 0.14 μm)<br>Gelatin (1.872) |
| 4 | Yellow Filter Layer: | R-1 (0.086) & S-2 (0.139) & ST-2 (0.012)<br>YD-2 Filter Dye (0.054)<br>Gelatin (0.646) |
| 5 | Fast Magenta Layer: | M-1 (0.075) Magenta Dye-Forming Coupler & S-1 (0.068) & ST-1 (0.0075), Addendum, R-2 (0.009)<br>MM-1 (0.054) Masking Coupler & S-1 (0.108)<br>IR-2 (.030) DIR Coupler & S-2 (0.060)<br>B-1 (0.003) & S-3 (0.004)<br>Green Sensitive Silver Iodobromide Emulsion (0.484 Ag),<br>4.0 mole % Iodide T-Grain (1.6 × 0.12 μm)<br>Gelatin (1.014) |
| 6 | Mid Magenta Layer: | M-1 (0.124) & S-1 (0.111) & ST-1 (0.012)<br>MM-1 (0.118) & S-1 (0.236), R-2 (0.015)<br>IR-3 (0.043) DIR Coupler & S-2 (0.043)<br>Green Sensitive Silver Iodobromide Emulsion (0.247 Ag),<br>4.0 mole % Iodide T-Grain (1.2 × 0.11 μm)<br>Green Sensitive Silver Iodibromide Emulsion (0.247 Ag)<br>4.0 mole % Iodide T-Grain (1.0 × 0.12 μm)<br>Gelatin (1.216) |
| 7 | Slow Magenta Layer: | M-1 (0.269) & S-1 (0.242) & ST-1 (0.027)<br>MM-1 (0.086) & S-1 (0.172)<br>IR-3 (0.011) & S-2 (0.011)<br>Green Sensitive Silver Iodobromide Emulsion (0.344 Ag),<br>3.5 mole % Iodide T-Grain (0.90 × 0.12 μm)<br>Green Sensitive Silver Iodobromide Emulsion (0.129 Ag),<br>1.5 mole % Iodide T-Grain (0.50 × 0.08 μm)<br>Gelatin (1.076) |
| 8 | Interlayer: | R-1 (0.086) Interlayer Scavenger, S-2 (0.139) & ST-2 (0.012)<br>Gelatin (0.538) |
| 9 | Fast Cyan Layer: | CC-1 (0.183) Cyan Dye-Forming Coupler & S-2 (0.210)<br>CM-1 (0.022) Masking Coupler<br>IR-4 (0.027) DIAR Coupler & S-2 (0.054)<br>Red Sensitive Silver Iodobromide Emulsion (0.592 Ag),<br>4.1 mole % Iodide T-Grain (1.7 × 0.12 μm)<br>Gelatin (0.915) |
| 10 | Mid Cyan Layer: | CC-1 (0.170) & S-2 (0.190)<br>CM-1 (0.032)<br>B-1 (0.008) & S-3 (0.010)<br>IR-4 (0.019) & S-2 (0.038)<br>Red Sensitive Silver Iodobromide Emulsion (0.194 Ag),<br>4.1 mole % Iodide T-Grain (1.20 × 0.11 μm)<br>Red Sensitive Silver Iodobromide Emulsion (0.236 Ag),<br>4.1 mole % Iodide T-Grain (0.91 × 0.11 μm)<br>Gelatin (1.076) |
| 11 | Slow Cyan Layer: | CC-1 (0.533) & S-2 (0.560)<br>IR-4 (0.026) & S-2 (0.052)<br>CM-1 (0.031)<br>B-1 (0.056) & S-3 (0.073)<br>Red Sensitive Silver Iodobromide Emulsion (0.463 Ag),<br>1.5 mole % Iodide T-Grain (0.54 × 0.08 μm) |

TABLE VII-continued
| MULTILAYER FILM STRUCTURE | |
|---|---|
| | Red Sensitive Silver Iodobromide Emulsion (0.301 Ag) |
| | 4.1 mole % Iodide T-Grain (0.53 × 0.12 μm) |
| | Gelatin (1.679) |
| 12 Antihalation Layer: | Gray Silver (0.135) |
| | UV-1 (0.075), UV-2 (0.030), S-1 (0.105), S-4 (0.015) |
| | YD-1 (0.034), MD-1 (0.018) & S-5 (0.018) |
| | CD-1 (0.025) & S-2 (0.125) |
| | R-1 (0.161), S-2 (0.261) & ST-2 (0.022) |
| | Gelatin (2.044) |
| Cellulose Triacetate Support | |
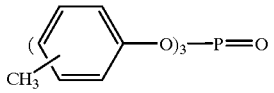
mixed isomers
S-1
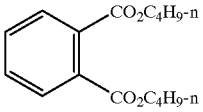
S-2
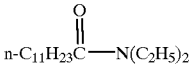
S-3
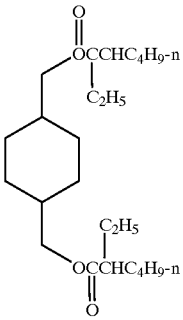
S-4
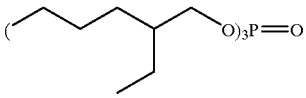
S-5
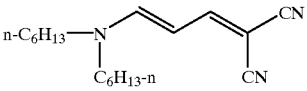
UV-1
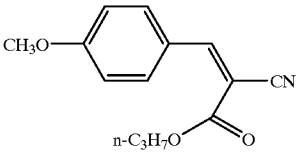
UV-2
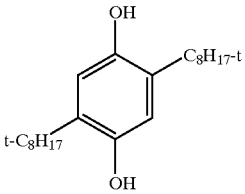
R-1
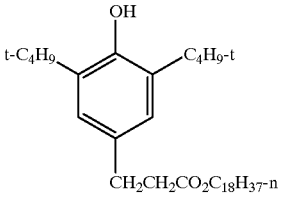
ST-2
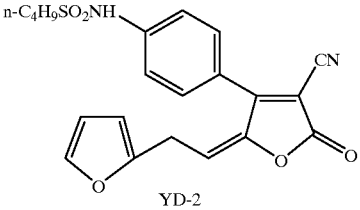
YD-2
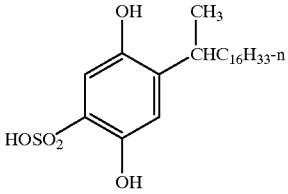
R-2

TABLE VII-continued
| MULTILAYER FILM STRUCTURE | |
|---|---|
| 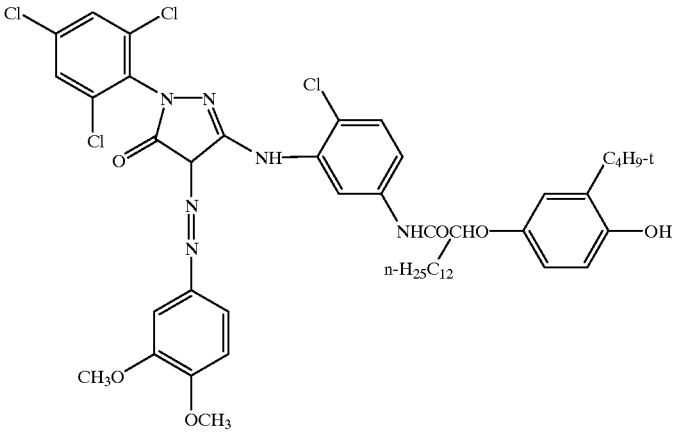 | MM-1 |
| 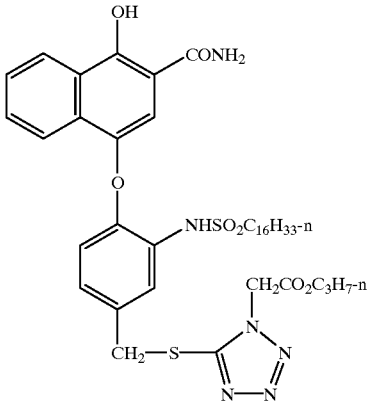 | IR-2 |
| 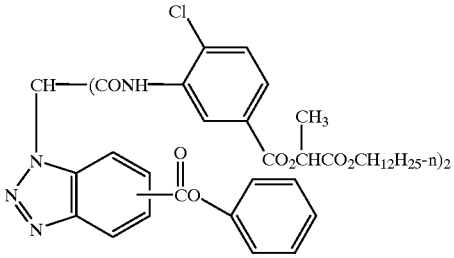 | IR-3 |
| 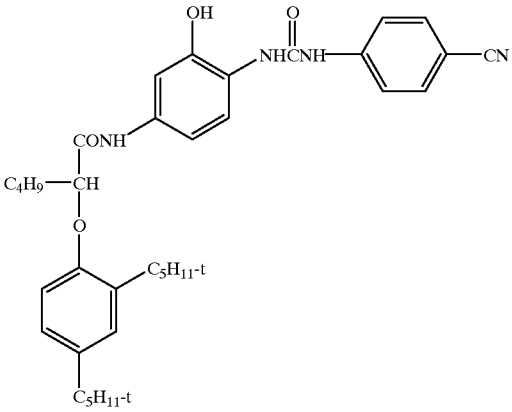 | CC-1 |

TABLE VII-continued
| MULTILAYER FILM STRUCTURE | |
|---|---|
| 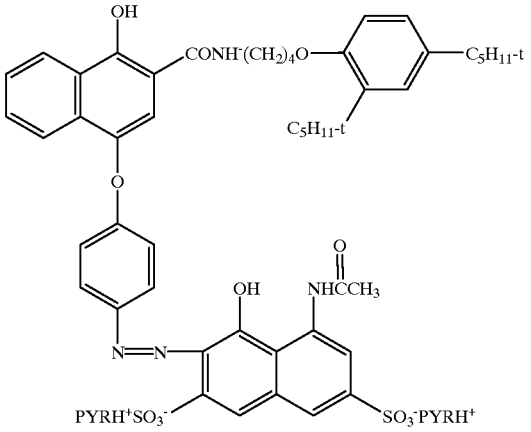 | CM-1 |
| 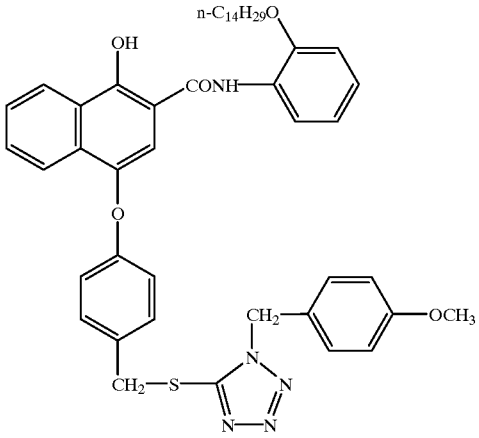 | IR-4 |
| 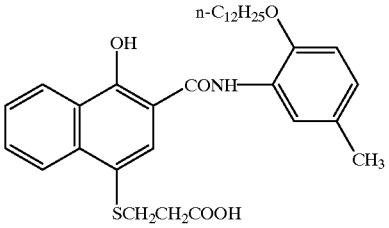 | B-1 |
| 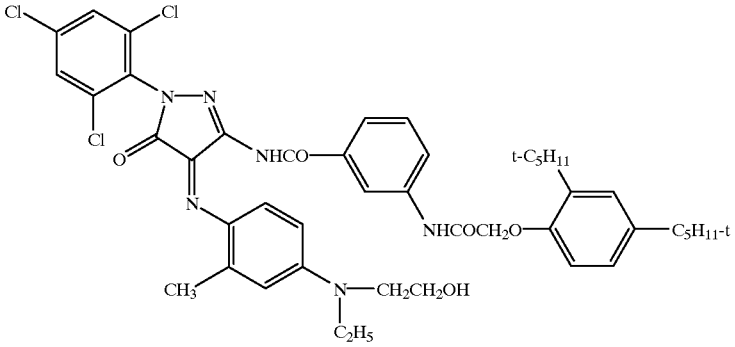 | MD-1 |

TABLE VII-continued

| MULTILAYER FILM STRUCTURE | |
|---|---|
| 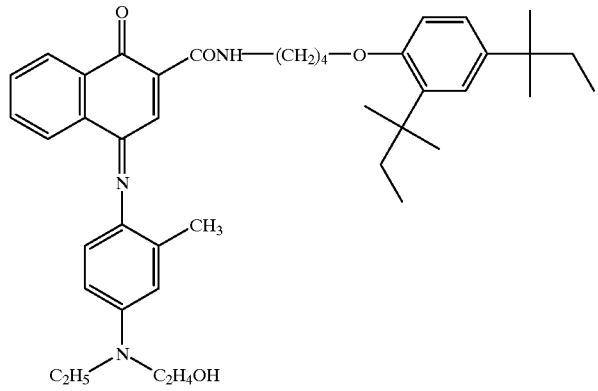 | CD-1 |
| 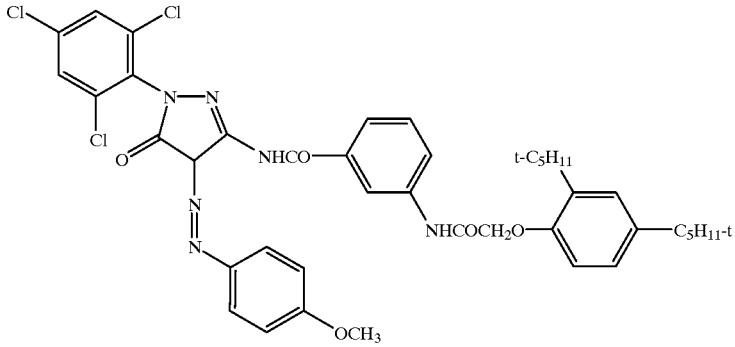 | YD-1 |

The preceding examples are set forth to illustrate specific embodiments of this invention and are not intended to limit the scope of the compositions, materials or methods of the invention. Additional embodiments and advantages within the scope of the invention will be apparent to one skilled in the art.

What is claimed is:

1. A photographic element comprising a support bearing at least one silver halide emulsion and at least one acylacetanilide yellow dye-forming DIR coupler of structure I, below

I

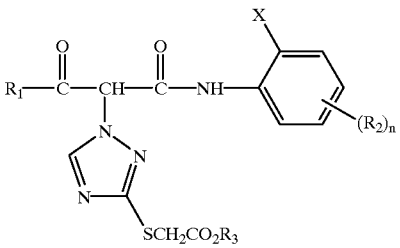

wherein:

the $R_1$ is a tertiary alkyl group or a phenyl group;

X is a halogen atom, an alkoxy group or an alkyl group;

$R_2$ is one or more substituent in the para position or either meta position relative to the anilino nitrogen and individually selected from the group consisting of halogen atoms, and alkyl, phenyl, alkoxycarbonyl, aryloxycarbonyl, sulfonamido, sulfamoyl, sulfonate, alkylsulfonyl, arylsulfonyl, sulfoxyl, acyloxy, carbamoyl, acyl, carbonamido and cyano groups;

n is 1, 2 or 3;

$R_3$ is an alkyl group having at least 6 carbon atoms or a phenyl group.

2. A photographic element according to claim 1, wherein the DIR coupler is coated in the same layer with at least one blue sensitive silver halide emulsion.

3. A photographic element according to claim 2, wherein the blue sensitive silver halide emulsion is a tabular grain emulsion.

4. A photographic element according to claim 1, wherein $R_3$ is an alkyl group with 7 to 12 carbon atoms.

5. A photographic element according to claim 1, wherein $R_1$ is a t-butyl group.

6. A photographic element according to claim 1, wherein X is a halogen atom.

7. A photographic element according to claim 1, wherein n is 1 and $R_2$ is a sulfonamido group or alkoxycarbonyl group para to the X group.

8. A photographic element according to claim 1, wherein the DIR coupler is coated at a level between 0.005 and 0.600 g/sq m.

9. A photographic element according to claim 1, wherein the DIR coupler is selected from the group consisting of:

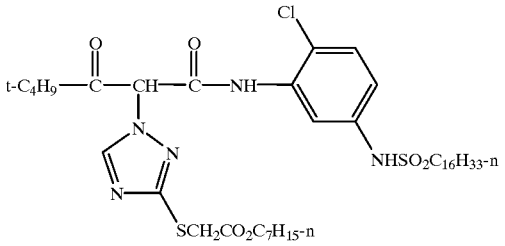

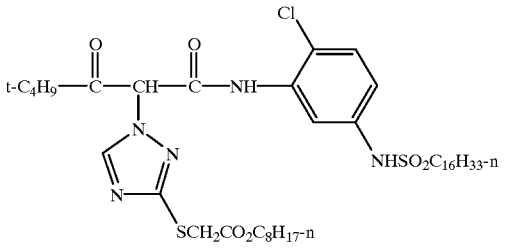

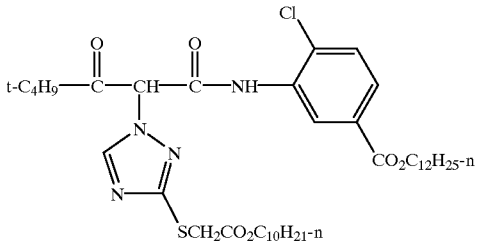

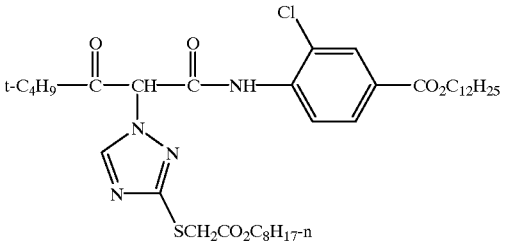

and

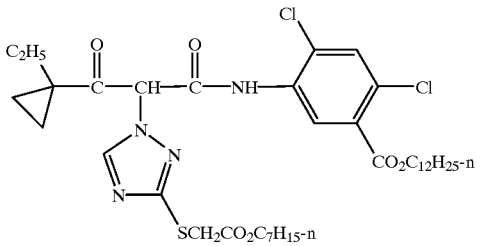

10. A photographic element according to claim 1, wherein the DIR coupler of structure I is used in the same layer as an acylacetanilide yellow dye-forming coupler of structure III:

III

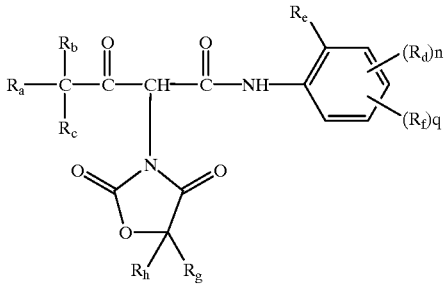

wherein:

$R_a$ is an alkyl, alkoxy, or aryloxy group;

$R_b$ is an alkyl or aryl group;

$R_c$ is hydrogen or an alkyl group;

$R_d$ is a substituent;

$R_e$ is selected from the group consisting of halogen, trifluoromethyl, alkoxy and aryloxy;

each $R_f$ is bonded at the 4- or 5-position relative to the anilino nitrogen and is independently a substituent selected from the group consisting of halogen, alkoxycarbonyl (—$CO_2G$), carbamoyl (—CONGG'), sulfonate (—$OSO_2G$), sulfamoyl (—$SO_2NGG'$), sulfonyl (—$SO_2G'$), trifluoromethyl, cyano, and sulfonamido (—$NGSO_2G'$), in which each G and G' is independently alkyl or aryl;

q is 1 or 2;

n is an integer from 0 to (3−q);

$R_g$ and $R_h$ are independently hydrogen or an alkyl group.

11. A photographic element according to claim 1, wherein the DIR coupler of structure I is used in the same layer as an acylacetanilide yellow dye-forming selected from the group consisting of:

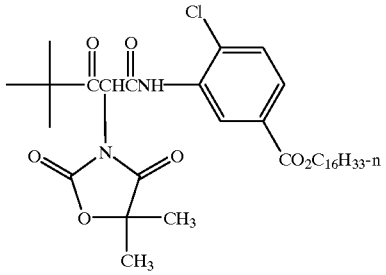

-continued
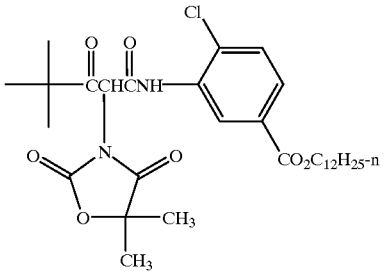
and
-continued
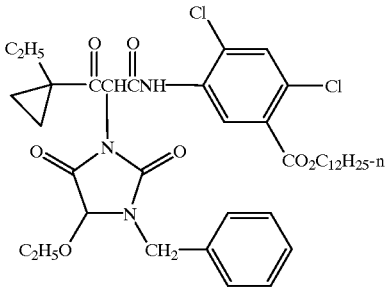
* * * * *